United States Patent [19]

Bigham et al.

[11] Patent Number: 4,684,180

[45] Date of Patent: Aug. 4, 1987

[54] SLIDING ELECTRIC CONTACTS

[75] Inventors: C. Bruce Bigham, Deep River; Robert J. Burton, Chalk River; James E. A. McGregor, Pembroke, all of Canada

[73] Assignee: Atomic Energy of Canada Limited, Ottawa, Canada

[21] Appl. No.: 826,370

[22] Filed: Feb. 5, 1986

[30] Foreign Application Priority Data

Feb. 6, 1985 [CA] Canada ..... 473690

[51] Int. Cl.[4] ..... H01R 39/18; H01R 39/32

[52] U.S. Cl. ..... 439/29; 439/816

[58] Field of Search ..... 339/8 R, 8 P, 256 RT, 339/5 R, 5 M

[56] References Cited

U.S. PATENT DOCUMENTS 3,649,946 3/1972 Frowein ..... 339/8 R 3,956,607 5/1976 Van Wijnandsbergen ... 339/256 RT X

FOREIGN PATENT DOCUMENTS 2035681 1/1972 Fed. Rep. of Germany ..... 339/256 RT

*Primary Examiner*—Eugene F. Desmond

*Attorney, Agent, or Firm*—Ronald G. Bitner

[57] ABSTRACT

An arrangement of sliding contacts for high current levels comprising a large number of closely spaced conductive spring contact elements formed of sheet material connected to one member and projecting obliquely towards another and for contact therewith, and wherein the projecting axis of the contact element is normal to the direction of relative motion of the members.

11 Claims, 8 Drawing Figures

SLIDING ELECTRIC CONTACTS

BACKGROUND OF THE INVENTION

This invention relates to sliding electric contacts for high currents and particularly for rf applications.

Sliding contacts are used in applications where easy adjustments are desired such as in resonant cavity tuning. A common application is in coaxial cavities tuned by a sliding short. The short must make electrical contact between the inner and outer conductor of the coaxial line and be easily movable. A suitable arrangement of contact "fingers" is often used successfully at low powers. However, at high powers, much more complicated clamping contacts, which must be released to move, have usually been used. To date, no simple arrangement using fingers is capable of reliably conducting high currents.

One of the difficulties with arrangements using fingers is that it is difficult to provide a sufficiently large number of contact elements per unit length. Also, no known material combines both high conductivity and good spring properties.

Another difficulty is the requirement for the conduction of heat away from the contact point.

SUMMARY OF THE INVENTION

Accordingly, an object of the present invention is to provide an arrangement of sliding contacts capable of high currents density.

It has been found that high currents can be conducted through a contact device utilizing sliding contacts that is configured in a manner so as to provide a large number of contacts per unit length.

Specifically, the present invention comprises an electric contact device for conductively connecting the surfaces of a pair of relatively movable members, comprising a plurality of electrically conductive spring contact elements formed of sheet material and having a base portion for attachment to one of said members, and a contact portion adapted to project obliquely towards a surface of the other member, the project ing axis of the contact element being normal to the direction of relative motion of the members, thereby allowing a large number of contacts per unit length.

DESCRIPTION OF PREFERRED EMBODIMENTS

Figure 1:
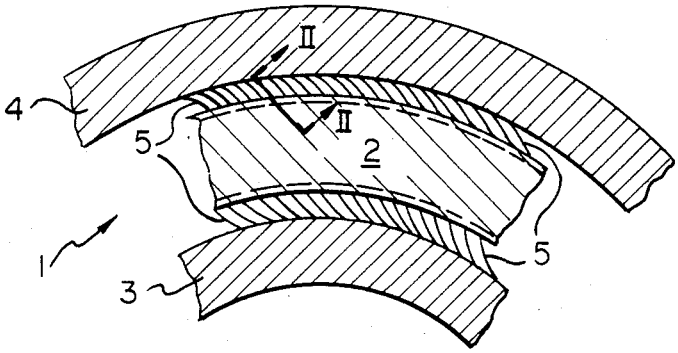
FIG. 1 is a sectional view of a sliding short assembly incorporating the sliding contacts of the present invention.

With reference to FIG. 1, a sliding short member 2 makes contact with an inner conductor 3 and outer conductor 4, which form a part of a coaxial resonator 1.

Figure 2:
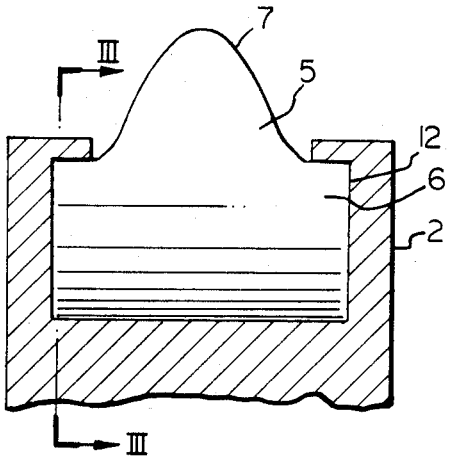
FIG. 2 is a sectional view taken at 2—2 of FIG. 1.
Figure 3:
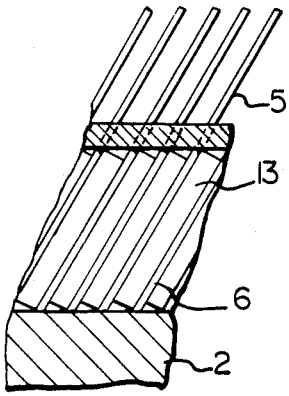
FIG. 3 is a sectional view taken at 3—3 of FIG. 2.

The sliding member 2 makes contact with the other members 3 and 4 through the conductive spring element 5, shown attached to the sliding member 2. With reference to FIGS. 1, 2, and 3, the conductive spring contact elements 5 are formed of sheet material and are tapered in width towards the tip. The contact elements are held at their base 6 between spacer elements 13 in the groove 12 and project obliquely therefrom. The projecting axis of the contact elements 5 are arranged normal to the direction of relative motion of the members.

The thickness of the spacers 13 placed between adjacent elements 5 at the base 6 is such that the elements 5 do not touch and provide the desired number of contacts. Both the elements 5 and the spacers 13 will preferably be soldered to the member 2 for good electrical and thermal contact.

The device is arranged so that the obliquely oriented elements 5 are resiliently biased against the adjacent member 3 or 4, making contact at the tip 7. The form and dimensions of 5 are such that contact force is maintained within acceptable limits over irregularities and/or uneven spacing. The contact force must be large enough for good contact and small enough for acceptably small wear. These parameters depend on the material chosen for contact elements 5 and member 3 or 4 in FIG. 1. Members 3 and 4 will normally be copper.

Generally, materials with high conductivity, i.e. copper, have poor spring properties. The usual material for such contacts is copper berylium with very good spring properties but significantly lower electrical and thermal conductivity compared to pure copper. Using berylium copper allows relative freedom in the form of element 5 but current carrying capacity will be limited by the conductivity. A copper silver alloy listed as alloy No. 155 in the Copper Development Handbook and available from Hussey Metals has conductivity close to pure copper and sufficiently good spring properties. Spring properties of the contact element are enhanced by tapering towards the tip as shown in FIG. 2.

A sliding short assembly was constructed having a configuration generally similar to that shown in FIGS. 1 and 2. Elements 5 were made from alloy 155, 0.012 mm thick, 14 mm in free length and spaced 1.5 mm apart. The assembly was water cooled and operated reliably at about 50 amps per cm in the range of 30 to 60 MHz.

Figure 4:
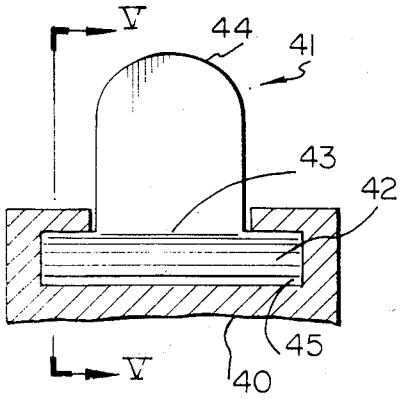
FIG. 4 is a sectional view showing an alternate embodiment of the sliding contacts.
Figure 5:
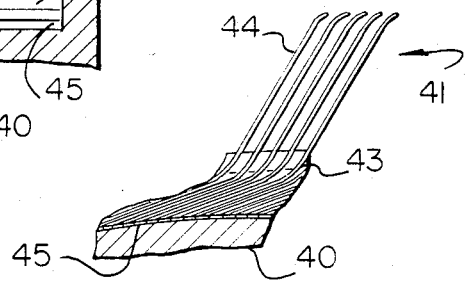
FIG. 5 is a sectional view taken at 4—4 of FIG. 4.

FIGS. 4 and 5 illustrate an alternate embodiment of maintaining and spacing contacts elements 41. The base portion 42 retained within the groove is bent at 43 to lie in a plane different from that of the projecting contact portion 44. Specifically, the base portion 42 lies in a plane at an angle nearer to tangency with the surface of the member 40 than the angle of the projecting contact portion 44. The angle of the base portions is chosen such that when adjacent base portions 42 abut with one another the projecting portions 44 have the desired spacing. Additionally, the lower portion of the base portion is provided with a tab comprising a downwardly bend portion 45 having a length corresponding to the desired spacing of the contact portion.

Figure 6:
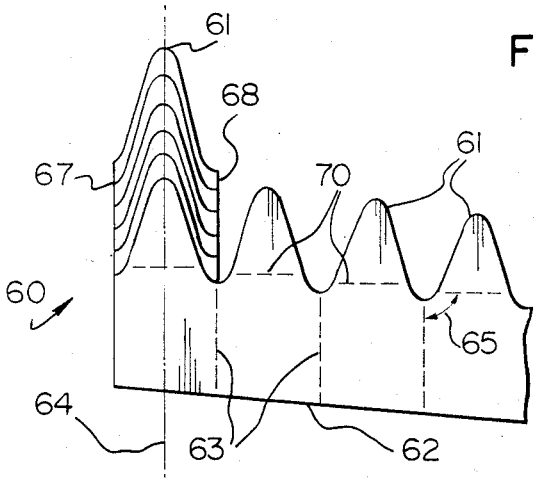
FIG. 6 illustrates a partially folded strip of one embodiment for the contact element.
Figure 7:
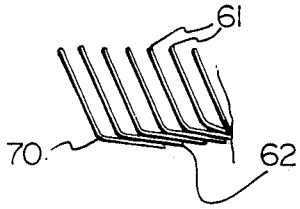
FIG. 7 is a side view showing a portion of the folded contact forming strip of FIG. 6.
Figure 8:
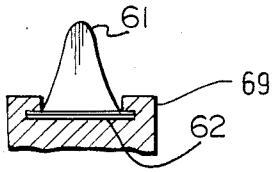
FIG. 8 is a partly sectional view showing the folded contact forming strip of FIG. 6 inserted into a conductor member.

FIGS. 6, 7, and 8 show an embodiment wherein the conductive spring elements 61 are integrally formed from a strip 60 of sheet material. The contact portions 61 are spaced along and project from one side of the strip, while the continuous portion 62 defines the support means for attachment to one of the members, as will be described.

With reference to FIG. 6, the strip 62 is folded 180°, alternately one way and then the other, along the parallel fold lines 63, disposed on each side of the contact defining portion 61.

The continuous portion 62 is inclined from normal to the fold lines 63, such that when folded, adjacent contact elements are spaced longitudinally from one another along the axis 64. It can be seen that the angle 65 will determine the pitch 66 of the contact elements when folded.

The outer sides 67 and 68 of the folded strip define flanges which may be used for supporting purposes, for example, by inserting into receiving grooves on the member 69, as shown in FIG. 8.

As in the previous embodiment of FIGS. 1 and 2, the contact elements 61 extend obliquely towards the surface to be contacted. With reference to FIG. 6, the contact elements 61 of the unfolded strip are alternately bent one way and then the other along the lines 70 to form the obliquely oriented contact elements when folded, as can be best seen in FIG. 7.

One use envisaged for the present invention is in a radiofrequency resonator for the accelerating structure of a cyclotron.

The present invention may also be used for a high current pin and socket connector wherein the spring contact elements are mounted on one of the two members, i.e. the pin or the socket.

We claim:

1. An electric contact device for conductively connecting the surfaces of a pair of relatively movable members, comprising a plurality of electrically conductive spring contact elements formed of sheet material and having a base portion for attachment to one of said members and a contact portion adapted to project obliquely towards a surface of the other member, the projecting axis of the contact element being normal to the direction of relative motion of the members, one of said members including a groove for receiving the base portion of said contact elements, said groove having a retaining portion of reduced width for engaging the base portion for retaining the contact elements, and wherein the depth of the groove is less than the height of the base portion of the contact element such that the maximum angle that the contact elements can project is limited to the desired oblique angle.

2. The apparatus of claim 1 wherein the contact portion is tapered in width toward the tip thereof.

3. The apparatus of claim 11 wherein the radiofrequency resonator is the accelerating structure of a cyclotron.

4. The apparatus of claim 3 wherein the cyclotron is a superconducting cyclotron.

5. The apparatus of claim 1 wherein the relatively moveable members define pin and socket elements of a connector.

6. An electric contact device for conductively connecting the surfaces of a pair of relatively movable members, comprising a plurality of electrically conductive spring contact elements formed of sheet material and having a base portion for attachment to one of said members and a contact portion adapted to project obliquely towards a surface of the other member, the projecting axis of the contact element being normal to the direction of relative motion of the members, one of said members including a groove for receiving the base portion of said contact elements, said groove having a retaining portion of reduced width for engaging the base portion for retaining the contact elements, and including spacers disposed within the groove between the base portions of adjacent contact elements.

7. An electric contact device for conductively connecting the surfaces of a pair of relatively movable members, comprising a plurality of electrically conductive spring contact elements formed of sheet material and having a base portion for attachment to one of said members and a contact portion adapted to project obliquely towards a surface of the other member, the projecting axis of the contact element being normal to the direction of relative motion of the members, one of said members including a groove for receiving the base portion of said contact elements, said groove having a retaining portion of reduced width for engaging the base portion for retaining the contact elements, and wherein each contact element is bent such that the base portion lies in a plane different from the contact portion and at an angle nearer to tangency with a surface of the member than the angle of the contact portion and whereby the base portion of adjacent contact elemens abut one another while the corresponding contact portions are spaced from one another.

8. The apparatus of claim 7 wherein the base portion further comprises a tab having a portion bend downward for contact with a lower surface portion of the groove, said tab having a length corresponding to the desired spacing of the contact portion.

9. An electric contact device for conductively connecting the surfaces of a pair of relatively movable members, comprising a plurality of electrically conductive spring contact elements formed of sheet material and having a base portion for attachment to one of said members and a contact portion adapted to project obliquely towards a surface of the other member, the projecting axis of the contact element being normal to the direction of relative motion of the members, one of said members including a groove for receiving the base portion of said contact elements, said groove having a retaining portion of reduced width for engaging the base portion for retaining the contact elements, and wherein said contact elements are integrally formed from a strip of sheet material and wherein said contact portions project from and are spaced along one side thereof, said strip being folded along fold lines on each side of the contact portions and folded substantially 180° alternately one way and then the other to define a plurality of closely spaced contact elements and wherein the spacing of the contacts is determined by the angle between the edge of the strip and the 180° fold lines.

10. The apparatus of claim 9 wherein the folded strip comprises flange portions delineated by said fold lines for placement into mating grooves on said one member.

11. The apparatus of claim 1 wherein the relatively moveable members are elements of a radiofrequency resonator.

* * * * *